US005826534A

United States Patent [19]

Huang

[11] Patent Number: 5,826,534

[45] Date of Patent: Oct. 27, 1998

[54] WHISTLE

[76] Inventor: King-Lin Huang, No.5, Kuang-Cheng Street, Pan-Chiao, Taipei, Taiwan

[21] Appl. No.: 798,553

[22] Filed: Feb. 11, 1997

[51] Int. Cl.[6] ..... B06B 13/00

[52] U.S. Cl. ..... 116/137 R; 84/330; 446/204

[58] Field of Search ..... 116/137 R; 446/204, 446/205, 206, 216; 84/330

[56] References Cited

U.S. PATENT DOCUMENTS

| | | | |
|---|---|---|---|
| 766,027 | 7/1904 | Fairchild | 84/330 |
| 805,727 | 11/1905 | Howe | 116/137 R |
| 1,315,019 | 9/1919 | Heyer | 116/137 R |
| 1,648,245 | 11/1927 | Rudolph | 446/206 |
| 1,779,795 | 10/1930 | Backstatter | 116/137 R |
| 2,617,324 | 11/1952 | Brody | 84/330 |
| 3,085,150 | 4/1963 | Bautsch | 446/204 |
| 4,893,580 | 1/1990 | Joseph, Jr. et al. | 116/137 R |
| 5,002,006 | 3/1991 | Ehrenreich | 116/137 R |
| 5,690,534 | 11/1997 | Shea | 446/205 |

*Primary Examiner*—Diego F. F. Gutierrez
*Assistant Examiner*—Andrew Hirshfeld
*Attorney, Agent, or Firm*—Bacon & Thomas

[57] ABSTRACT

A portable whistle is assembled from an injection molded main body having an air blowing opening within which an injection molded plug is inserted so that whistling is created when air is blown into the opening and through a groove formed in the plug and a slot formed in the body.

4 Claims, 4 Drawing Sheets

WHISTLE

BACKGROUND OF THE INVENTION

1. Field of the Invention

The present invention relates to an improved whistle, and especially to a portable whistle which can be assembled easily and is formed by injection molding, thereby lowering its cost of manufacturing. It is convenient to use due to its portability.

2. Description of the Prior Art

The method for generating sound on a whistle takes the advantage of consonance by vibrating an air column to double the volume of sound produced. Therefore, a whistle must be a hollow pipe-like article for generating an air column, and both a slot and an air blowing opening must be provided at one side and the end of the hollow pipe. The speed of air blown in the air blowing opening must be fast so that the air blown into the hollow pipe has a faster speed and rushes out the slot to generate a whirling air flow which vibrates the air column in the hollow pipe to induce consonance. The air blowing opening must be a thin opening extending from the end of the hollow pipe to a position in front of the slot, so that when air is blown in from the air blowing opening, it can enter into the hollow pipe and reach the slot simultaneously, thus generating a whirling air flow which vibrates the air column, thus creating a shrill whistling sound.

The conventional techniques of making a whistle includes making a hollow pipe-like article of aluminum or other metallic material, and then forming a notch on the end thereof. A mouth piece for blowing is mounted on the end of the metallic hollow pipe, thus permitting the slim air flow blown in through the mouth piece to rush out the slot and generate a whirling air flow which creates whistling. Therefore, the manufacturing process has to first make a pipe, a slot is then cut out on the front end of the pipe, a mouth piece is then made and mounted on the end of the hollow pipe, and the opening of the mouth piece is aligned with the slot. Such manufacturing process is expensive and the weight of the product is not light. Most customers do not like the expensive costs and inconvenience of using such products. Thus, conventional whistles have disadvantages.

SUMMARY OF THE INVENTION

In view of this, the present invention provides an improved whistle for eliminating disadvantages in the prior art.

In particular, the whistle of the present invention includes a main body and a plug piece which are injection molded from plastic material. The plug piece is inserted in the front end of the main body to complete assembling of the present invention.

The main body is integrally formed as a rod, and the rear end thereof can be attached with a key ring or connected with a chain etc. An air opening is provided on the front end thereof, and a slot is provided on one side thereof. The plug piece is in the form of a sheet member, and can be inserted from the front end of the air opening to reach the front end of the slot. A shallow groove is provided on the upper surface thereof, so that when the plug piece is inserted in the air opening, a gap is formed between the shallow groove and the air opening.

When a user blows air from the front end of the air opening, air passing through the gap and the plug piece and the top surface within the air opening is accelerated by virtue of the plug piece. The air then reaches the slot and rushes out of the latter to form a whirling air flow, so that the air column in the air opening is vibrated to induce consonance and create whistling.

The whistle of the present invention only requires integrally forming the main body and the plug piece by injection molding with plastic material, and then inserting the plug piece directly into the main body to complete the assembly. The assembly process requires only one step of insertion of the plug piece into the main body, and no other processing procedure is required, thus saving time and lowering the cost of manufacturing. Moreover, since the whistle is integrally formed by injection molding with plastic material, it is very small and portable, and can be attached with a key ring or connected with a chain, etc. Further, a lamp seat can be provided on the lower side of the main body for receiving batteries and an indicating light for illumination at night. The whistle of the present invention is thus provided with multiple functions.

The present invention will be apparent after reading the detailed description of the preferred embodiments thereof with reference to the accompanying drawings.

DETAILED DESCRIPTION OF THE PREFERRED EMBODIMENTS

Figure 1:
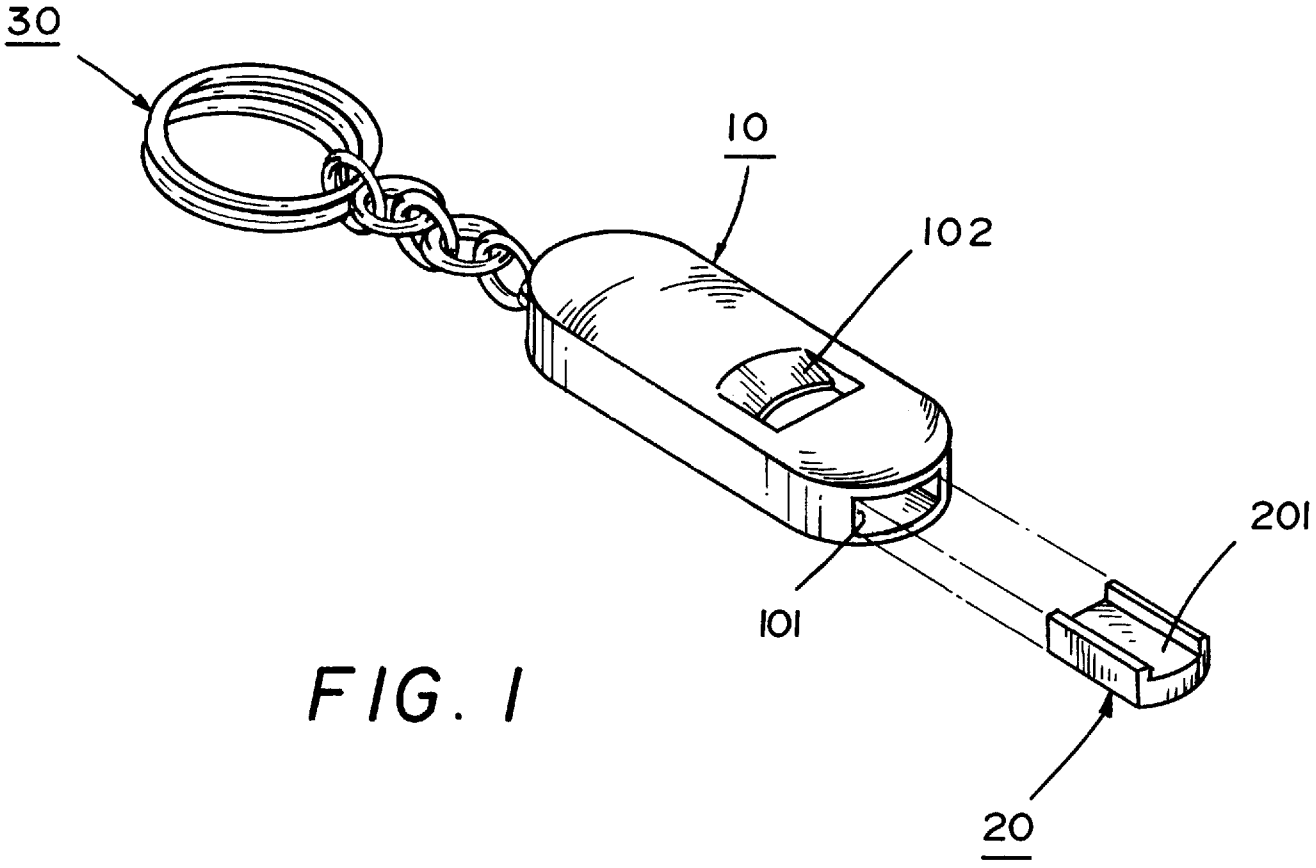
FIG. 1 is a perspective view of the first embodiment of the present invention.
Figure 2:
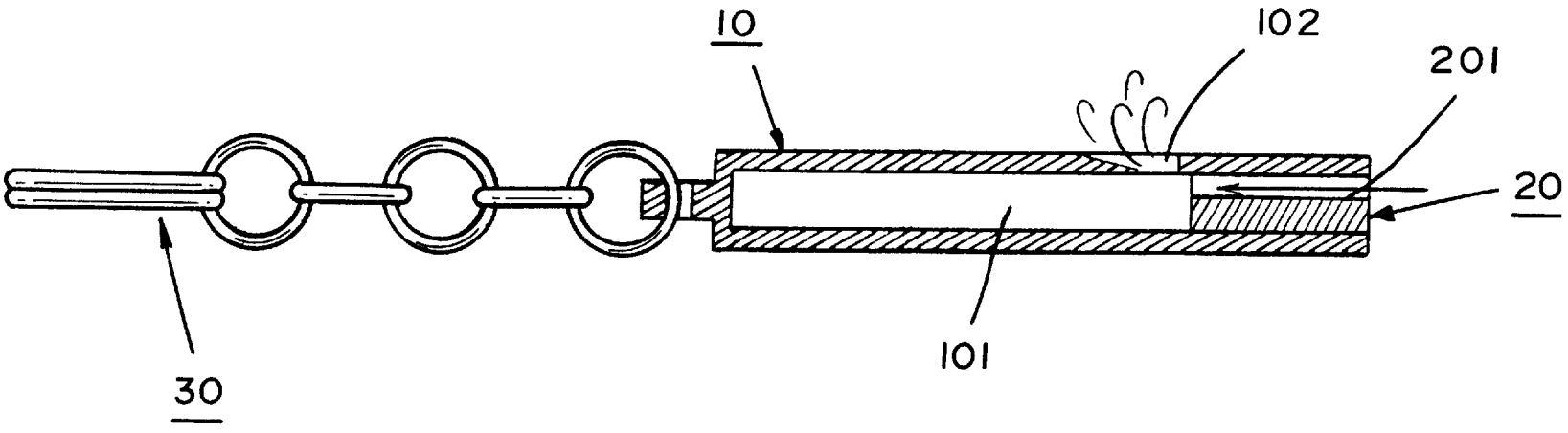
FIG. 2 is a side sectional view of the first embodiment of the present invention.

It can be see from FIGS. 1 and 2 that the improved whistle of the present invention is comprised mainly of a main body 10 and a plug piece 20.

The main body 10 is injection molded and is of a rectangular rod shape, and the rear end thereof can be attached with a key ring 30 or connected with a chain, etc. An air opening 101 is provided on the front end thereof, and a slot 102 is provided on one side thereof. The slot 102 is spaced a suitable distance from the air opening 101 and communicates internally with the latter.

The plug piece 20 is in a form of a sheet member, and is sized to be inserted into the air opening 101 from the front end thereof to reach the front edge of the slot 102. A shallow groove 201 is provided along the entire upper surface of the plug piece 20 so that when the plug piece 20 is inserted in the air opening 101, a gap is formed between the plug piece 20 and the top surface of body 10 within the air opening 101. Both sides of the plug piece 20 snugly contact with the body 10 at the air opening 101 to prevent its detachment.

When a user blows air from the front end of the main body 10 into the air opening 101, air only passes through the gap between the shallow groove 201 and the air opening 101 and is accelerated by virtue of the plug piece 20. When the air passing through the plug piece 20 reaches the slot 102, there is originally air behind the air opening 101, so that air flow blown in will rush out of the slot 102 to form a whirling air flow. Meanwhile, the air column in the air opening 101 is vibrated to induce consonance and create whistling to implement the function of a whistle.

The above stated structure for a whistle is made by injection molding plastic material to integrally form the main body 10 and the plug piece 20, and simply inserting the plug piece 20 in the main body 10 to complete the present invention. Thus, the present invention can save time and cost of manufacturing, and yet it occupies a very small space, weighs little, and is portable, thereby providing an object for convenient use.

Figure 3:
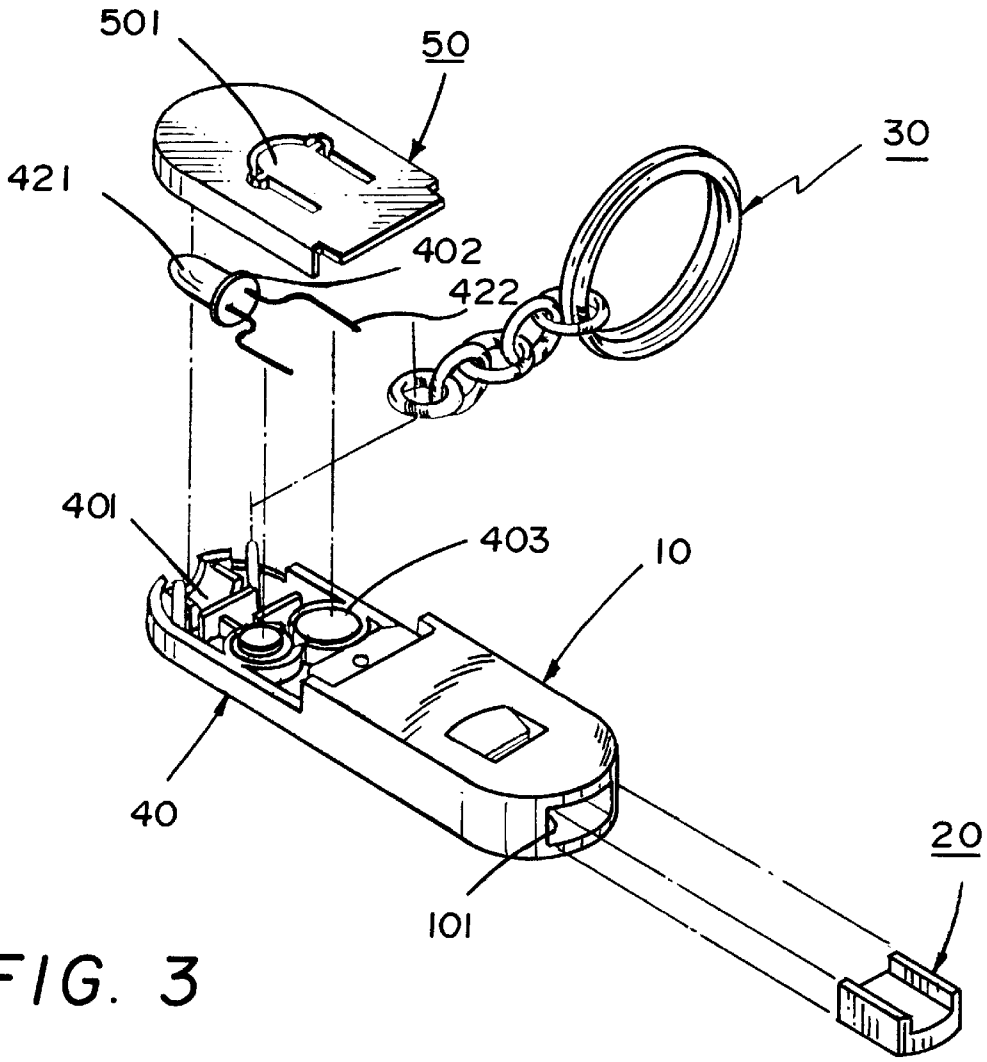
FIG. 3 is an exploded perspective view of the second embodiment of the present invention.
Figure 4:
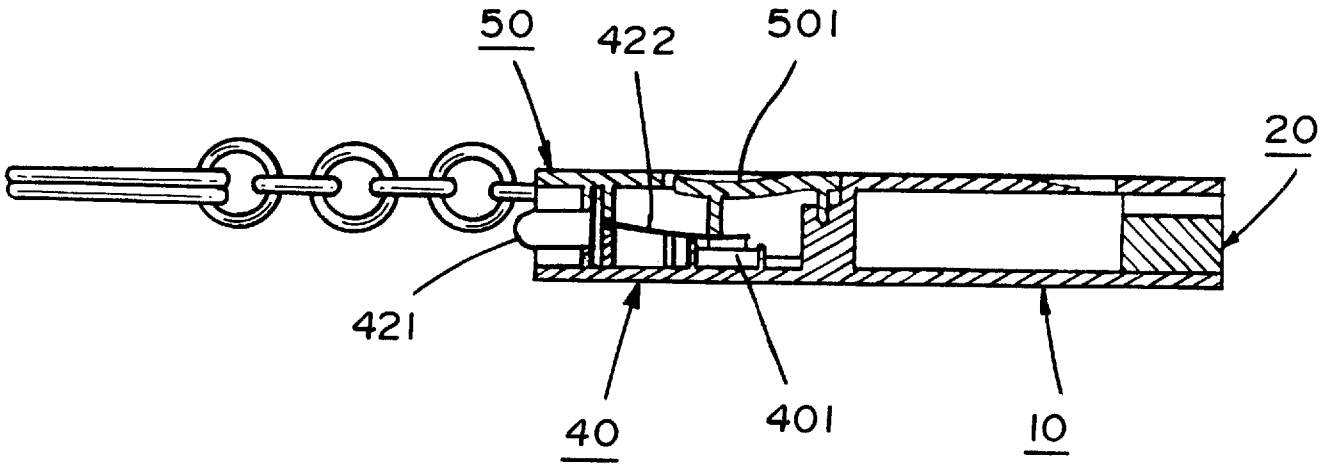
FIG. 4 is a side sectional view of the second embodiment of the present invention.

As seen in FIGS. 3 and 4, a lamp seat 40 can be provided integrally on the lower side and the rear end of the main body 10 and has a plurality of receiving grooves, including a seat 401 for receiving a bulb 402 and batteries 403. A light emitting portion for 421 of the bulb 402 is exposed to the outside of the lamp seat 40, while wires 422 of the lamp are placed on the batteries 403. A lid 50 covers the lamp seat 40. The lid 50 is provided with a press member 501 above the wires 422, so that when a force is exerted on the press member 501, the wires 422 can be electrically connected to the batteries 403 to activate the light emitting portion 421 of the bulb 402. A user can thereby use this illumination to locate a key hole at night. The invention thus has multiple functions.

Having thus described my invention, what I claim as new and desire to be secured by Letters Patent of the United States is:

1. A whistle comprising:

a) a main body in the form of a hollow rectangular-shaped rod including a front end defining an air opening and a side having a slot formed therethrough, the slot having a front edge, the main body being entirely injection molded from a plastic material;

b) a plug in the form of a sheet member including a front end, a rear end and an upper surface, the plug being sized for inserting into and snugly fitting within the air opening of the body to position the front end of the plug adjacent the front edge of the slot, the upper surface of the plug including a groove extending from the front end to the rear end of the plug and defining a gap with an inner surface of the main body forming the air opening, the plug being entirely injection molded from a plastic material; and c) wherein when a user blows into the air opening of the main body, the air passes through the gap and is accelerated out through the slot to form a whirling air flow that vibrates an air column formed in the air opening, thereby inducing consonance and creating a whistling sound.

2. The whistle of claim 1 wherein the main body further includes a key ring secured thereto.

3. The whistle of claim 1 wherein the main body further includes a chain secured thereto.

4. The whistle of claim 1 wherein:

a) the main body further includes a rear end defining a lamp seat therein;

b) a light bulb and a battery source disposed within the lamp seat, the bulb including a light emitting portion exposed to the exterior of the main body; and c) a lid covering the lamp seat, the lid including a press member for placing the battery source into electrical connection with the bulb to illuminate the bulb.

* * * * *